United States Patent [19]

Noyes

[11] Patent Number: 4,634,203

[45] Date of Patent: Jan. 6, 1987

[54] UNIVERSAL INTERNAL LATCH AND LOCK D SHELL CONNECTOR

[75] Inventor: Robert W. Noyes, Framingham, Mass.

[73] Assignee: Honeywell Information Systems Inc., Waltham, Mass.

[21] Appl. No.: 749,243

[22] Filed: Jun. 27, 1985

[51] Int. Cl.[4] ..... H01R 13/639

[52] U.S. Cl. ..... 339/91 R; 339/92 M; 339/126 R; 339/128

[58] Field of Search ..... 339/91 R, 92 R, 92 M, 339/128, 126 R

[56] References Cited

U.S. PATENT DOCUMENTS 3,824,525 7/1974 Keller ..... 339/91 R

FOREIGN PATENT DOCUMENTS 1196099 6/1970 United Kingdom ..... 339/91 R
2042827 9/1980 United Kingdom ..... 339/91 R
2088150 6/1982 United Kingdom ..... 339/92 R

*Primary Examiner*—John McQuade
*Attorney, Agent, or Firm*—Nicholas Prasinos; John S. Solakian

[57] ABSTRACT

A novel method and apparatus for latching and locking D-type electrical connectors. In one embodiment a novel "bud-stud" is utilized to replace prior art iso-blocks or prior art hexagonal nuts. The bud-stud is capable of mating with either a prior art screw-type or spring-loaded latching arm to latch and lock the electrical connectors to each other and to a bulkhead.

7 Claims, 8 Drawing Figures

UNIVERSAL INTERNAL LATCH AND LOCK D SHELL CONNECTOR

BACKGROUND

1. Field of the Invention

This invention relates generally to electrical connectors, and more particularly to a method and hardware for latching and locking internal and external bulkhead cables or to latch and lock two separate cables.

2. Description of the Prior Art

The prior art is replete with various hardware, methods and techniques for connecting electrical cables. Typical of prior art hardware for mounting and latching D-type electrical connectors are shown on FIGS. 1 and 2.

Referring now to FIG. 1 there is shown a typical prior art electrical connector assembly in exploded view. Typically one of the molded assemblies 101 for connecting electrical cable 100A to electrical cable 100B is mounted on the bulkhead mounting plate 104 via a hexagonal screws 107, 112 which thread into threaded nut assemblies 105, 109 which are pressed into the flange plate of the connector 101. The external end of the connector, having a molded assembly 103, is also mounted to the other side of the bulkhead mounting plate 104, by utilizing threaded screws 108, 110, which are held in place on the flange of connector molded assembly 103 via retainer clips 106, 111 pressed over the ends of the molded connector assembly flange. The head of screws 107, 112 have internal threads 107A, 112A into which the threaded portion of screws 108, 110 can screw, thus latching and locking the two assemblies 101, 103 firmly onto the bulkhead mounting plate 104.

In another type of prior art latch and lock device, an isoblock latch (International Standards Organization latch) mates with latching fingers. This type of prior art device is typically shown on FIG. 2.

Referring to FIG. 2, the molded connector assembly 201 has threaded inserts 205, 209 pressed into the flange of the connector assembly 201. Threaded screws 217, 219 are utilized to attach isoblocks 218, 220 to the bulkhead mounting plate 204 by threading screws 217, 219 into the threaded inserts 205, 209. This portion of the assembly then forms the internal portion having the bulkhead mounting plate as the boundary. The external connector assembly 203 has latching arms 213, 214 which are spring-loaded and held in position by roll pins 215, 216. Accordingly the latching arms are free to rotate around pins 215, 216 when the external connector assembly 203 is pressed into the internal connector assembly 201 via opening 201A. It should be noted that the latching arms 213, 214 have a beveled lip 213A, 214A which mates with the beveled lip of isoblocks 218, 220 respectively and forces the latching arms 213, 214 to pivot slightly around pins 215, 216. Once the lips 213A and 214A latch with the lips of isoblocks 218, 220, the spring forces the latching arm back into a vertical position thus latching external connector assembly 203 onto the bulkhead mounting plate 204 thereby connecting electrical cable 200A attached to connector assembly 201 with electrical cable 200B attached to connector assembly 203.

These types of prior art mounting mechanisms and techniques have several disadvantages in the field. The threaded portions of the screws could be misaligned when screwed into the connector. Additionally the inserts for receiving screws, or the screws themselves, would fall out many times. Screws did become loose in use which made the connector assembly malfunction. In order to correct this problem different types of clips, C-rings, O-rings, new types of inserts, nuts, lock washers, have been used with little success in correcting the problem. Additional disadvantages of utilizing screws and nuts was the cost of labor in assembly and the need of hardware to latch the connectors, such as screwdrivers and nut drivers.

To correct some of these problems, the assembly of FIG. 2 was developed which utilized isoblocks and latching arms to latch the connectors together. However the disadvantage to this type of arrangement was that it was not backward compatible, in that if an external connector assembly had latching arms and the internal connecting assembly was provided with the prior art hexagonal screw attachment, the two pieces could not be attached and latched. What was needed to make this backward compatible was a new type of device which could not only latch prior art type connector assemblies utilizing screws, but prior art type assemblies utilizing latching arms. Additionally a new type latching assembly for the internal molded connector assembly was needed in order to minimize labor costs, eliminate mounting tools and minimize labor costs in mounting in the field.

OBJECTS OF THE INVENTION

A primary object of the invention, therefore, is to provide a new apparatus and technique for mounting-/latching D-subminiature type connectors.

Another object of the invention is to provide a method and apparatus which is backward compatible for mounting/latching D-subminiature connectors to prior art screw-type devices, as well as to latching arm type devices.

Still another object of the invention is to provide a totally new and novel apparatus and technique for mounting/latching D-subminiature connectors utilizing no tools and a minimum of labor.

These and other objects of the invention will become apparent from the description of the preferred embodiments of the invention, when read in conjunction with the drawings contained herewith.

SUMMARY OF THE INVENTION

One embodiment of the invention utilizes the same threaded inserts 105, 109, 108, 110 which correspond to inserts 305, 309, 308, 310, but a new type stud, called a "bud-stud", 307, 312 is substituted for the screws 107, 112. The bud-stud 307, 312 is circular and has grooves 307A, 307B. Accordingly the internal and external connector assemblies can be latched and locked utilizing the prior art screw and nut technique, but can also be forward compatible and utilize external connectors having latch spring-loaded latching arms as shown in FIG. 6A.

In another embodiment both the internal and external molded connectors have latching arms 513, 514, 501, 501AB. The latching arms of the internal connector can be squeezed through the bulkhead mounting plate opening and protrude to the exterior where they are available to be latched by the prior art external molded connectors having spring-loaded arms.

BRIEF DESCRIPTION OF THE DRAWINGS

The novel features which are characteristic of the invention are set forth with particularity in the appended claims. The invention itself, however, both as to organization and operation, together with further objects and advantages thereof, may be best understood by reference to the following description, taken in conjunction with the drawings in which:

DESCRIPTION OF PREFERRED EMBODIMENTS OF THE INVENTION

Figure 1:
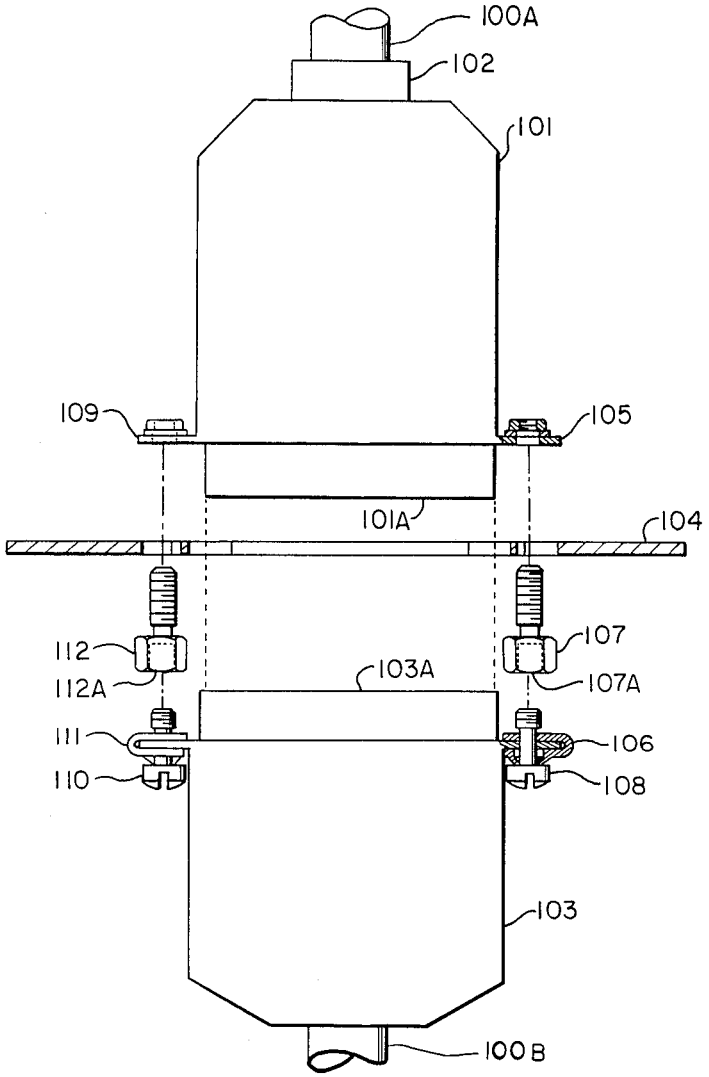
FIG. 1 PRIOR ART
FIG. 1 is an exploded side view of one type of prior art electrical connector assembly utilizing nuts and screws.
Figure 2:
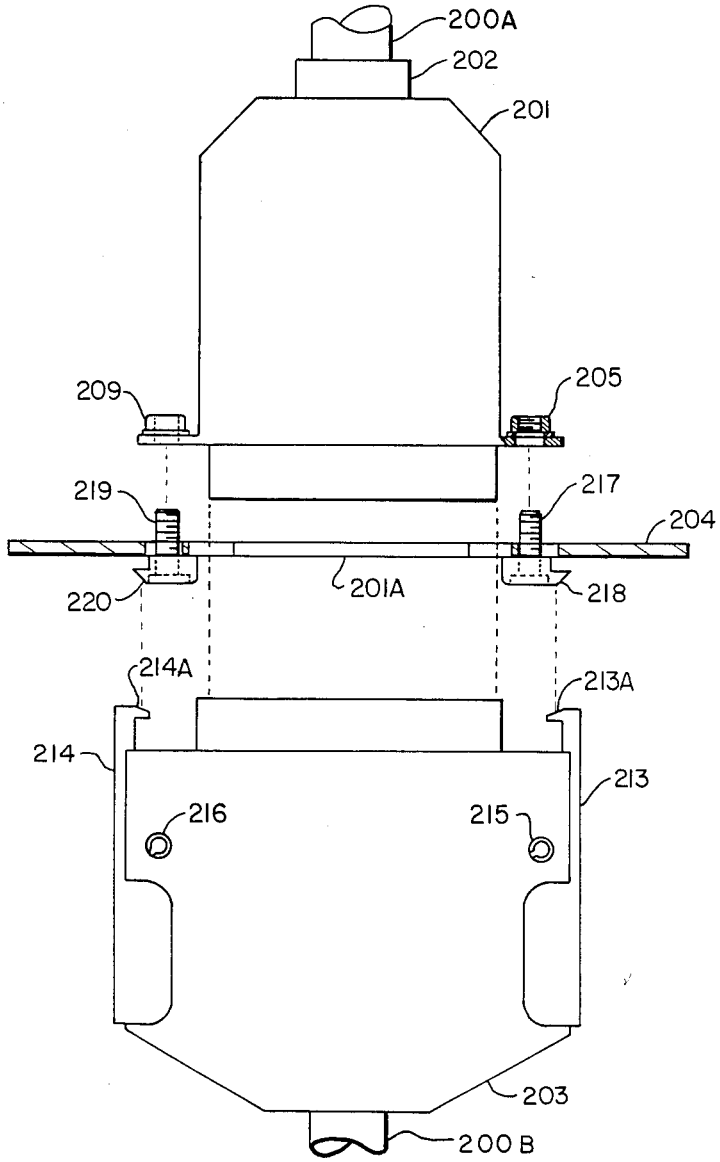
FIG. 2 PRIOR ART
FIG. 2 is another type of prior art assembly utilizing threaded inserts, isoblocks and latching arms.
Figure 3:
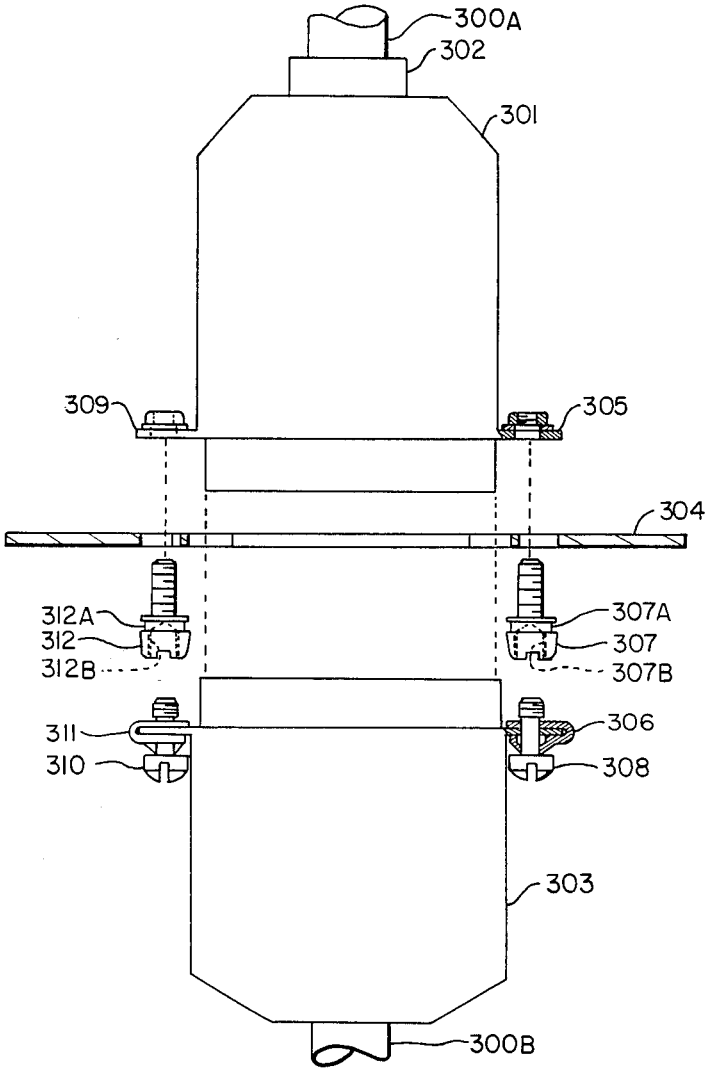
FIG. 3 is an exploded side view showing one embodiment of the invention.

Referring now to FIG. 3, there is shown an exploded side view diagram of a first embodiment of the invention. A molded connector 301 attached to electrical cable 300A has similar type threaded inserts 305, 309 as the prior art. Also the external molded connector assembly 303 has captive-threaded inserts 308, 310 which are retained on the flange of molded assembly 303 via retainer clips 306, 311. However in place of a prior art threaded stud 107, there is a cylindrical latching stud, known as a "bud" stud. The "bud" stud 307, 312 is cylindrical and has an undercut portion 307A, 307B and a threaded nut portion 307B, 312B which can receive a threaded screw 308, 310. In this embodiment the bud stud is utilized to mount and latch the internal and external molded electrical connectors 301, 303 utilizing threaded inserts 305, 309 and threaded screws 308, 310. In this embodiment, a molded electrical connector 301 forms the internal portion of the connector mounted on bulkhead mounting plate 304. It can be seen that in the field, the external bulkhead connector 303 attached to electrical cable 300B may be discarded, and in its place an external-type molded electrical connector 403 attached to electrical cable 400B having latching arms 413, 414, as shown on FIG. 4, may be utilized. Without the bud stud, it would be impossible to make a connection directly to the internal connector unless the old-style threaded screw 107, 112 of FIG. 1 were replaced by an old-style isoblock 218, 220 shown on FIG. 2. Hence by utilizing the bud-stud the external connectors are backward compatible to internal connectors and a cable 300A attached to an internal connector of the bulkhead can be coupled to electrical cable 300B or 400B which are attached to different types of external connectors.

Figure 4:
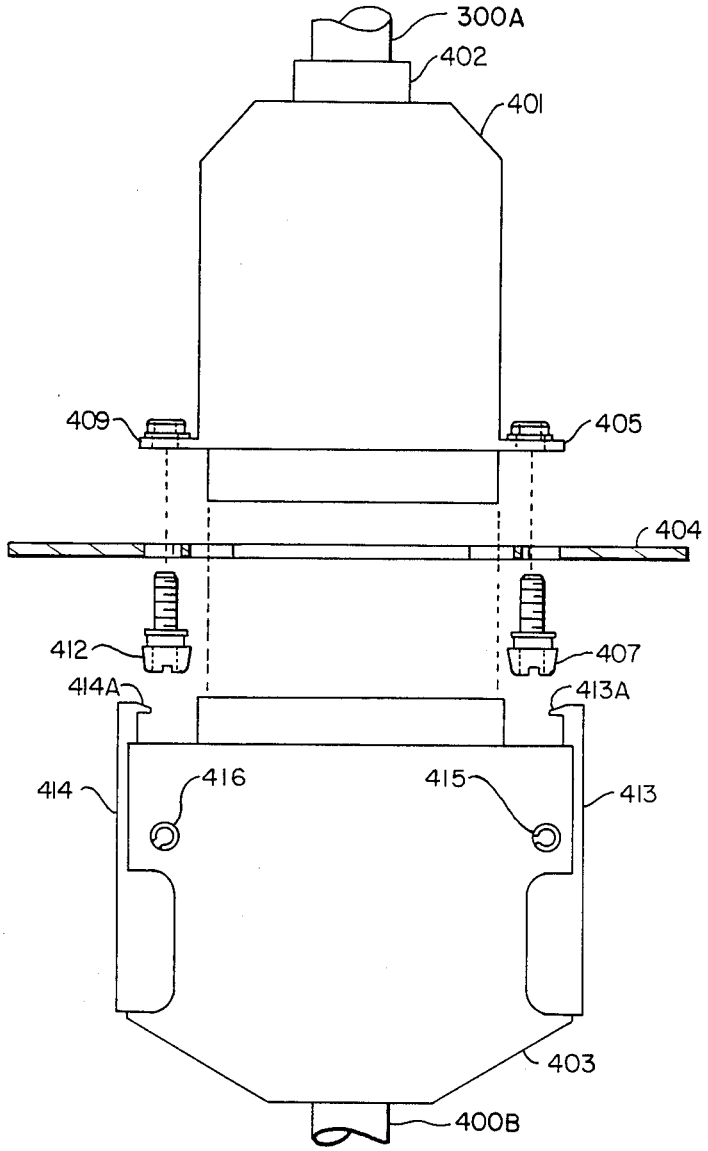
FIG. 4 is an exploded side view showing a second embodiment of the invention.

FIG. 4 shows an exploded view of the invention utilizing the bud stud with the latching arms. Internal molded electrical connector 401 has similar pressed threaded inserts 405, 409. The internal electrical connector 401 is latched and locked onto the bulkhead mounting plate 405 utilizing the bud stud 407. In this embodiment the external molded electrical connector assembly 403 having spring-loaded latching arms 413, 414 mounted onto the connector assembly 403 via pins 415, 416, can be pressed upward and onto the recessed portion of bud stud 407, 412 so that the external connector 403 is latched and locked to the bulkhead plate 404 via bud-studs 407, 412.

Figure 6B:
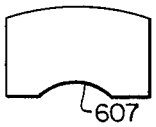
FIGS. 6A and 6B show a detailed view of one feature of the invention.
Figure 6A:
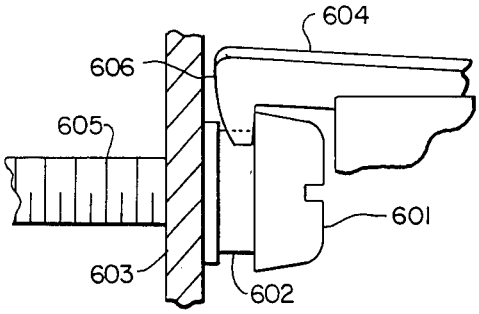

The details of this latching and locking are shown on FIGS. 6A and 6B. The bud stud (601, 602, 605) has an undercut portion 602 and a screwed portion 605. The screw portion passes through the bulkhead mounting plate 603 and screws into the threaded insert, previously described but not shown in this Figure. The lip of the latching arm 604 fits into the undercut portion of the bud-stud and latches the outside connector assembly to the bulkhead plate 603. The latching arm 604 has a head or latching portion 606 which is curved and tapered (as shown on FIG. 6A) in order to ride over the head section 601 of bud stud (601, 602, 605). Referring to FIG. 6B there is shown a front view of the latching arm 604. It should be noted that there is a circular undercut 607 so that the lip of the latching arm fits snugly around the shaft of the undercut portion of the bud-stud.

Figure 5:
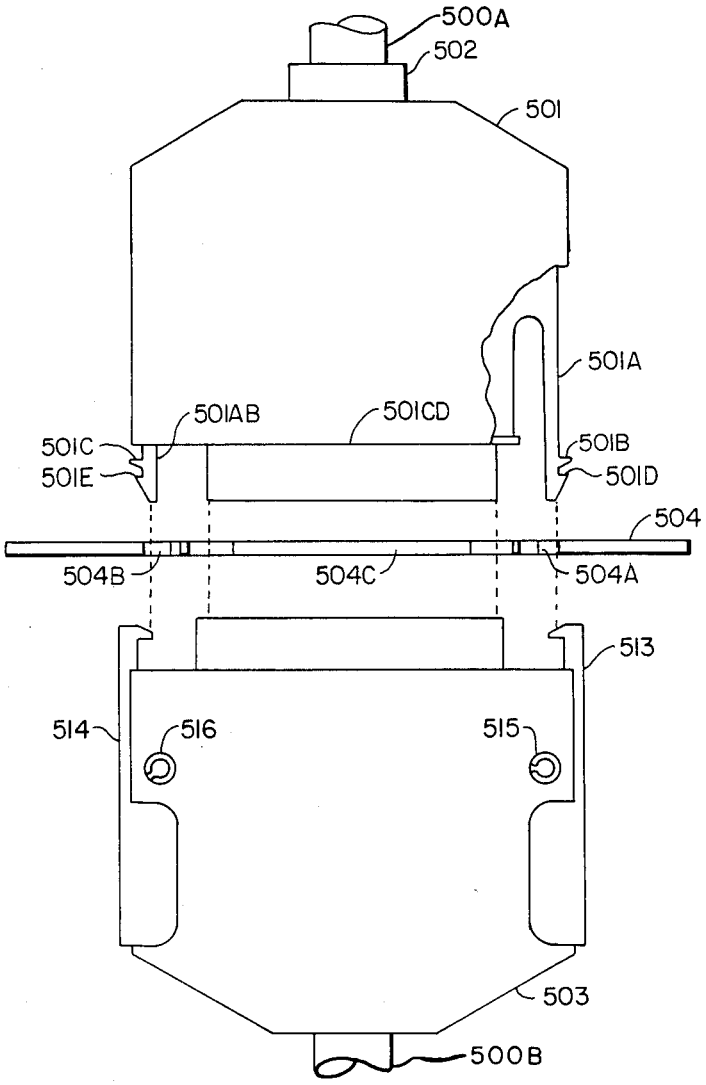
FIG. 5 is an exploded side view showing a third embodiment of the invention.

Referring now to FIG. 5, there is shown a third embodiment of the invention wherein the internal molded connector assembly 501 attached to electrical cable 500A is provided with flexible arms 501A and 501AB having protrusions 501B and 501C which is spaced vertically from bridge 501CD equal to the thickness of the bulkhead mounting plate 504. Accordingly when the internal connector assembly 501 is pressed so that the arms 501A and 501AB pass through holes 504A and 504B respectively, they will spring outwardly after passing through a latch in the molded assembly connector 501 to the bulkhead mounting plate 504 leaving lips 501D and 501E exposed. When the external connector 503 attached to electrical cable 500B, having latching arms 513 and 514, is pressed upward and the female and male connectors mate, the lips of the latching arms 513 and 514 will latch onto the lip 501D and 501E of resilient arms 501A and 501AB. Latching arms 513 and 514 are spring-loaded 515 and 516 and rotatably mounted on the external connector 503.

Figure 7:
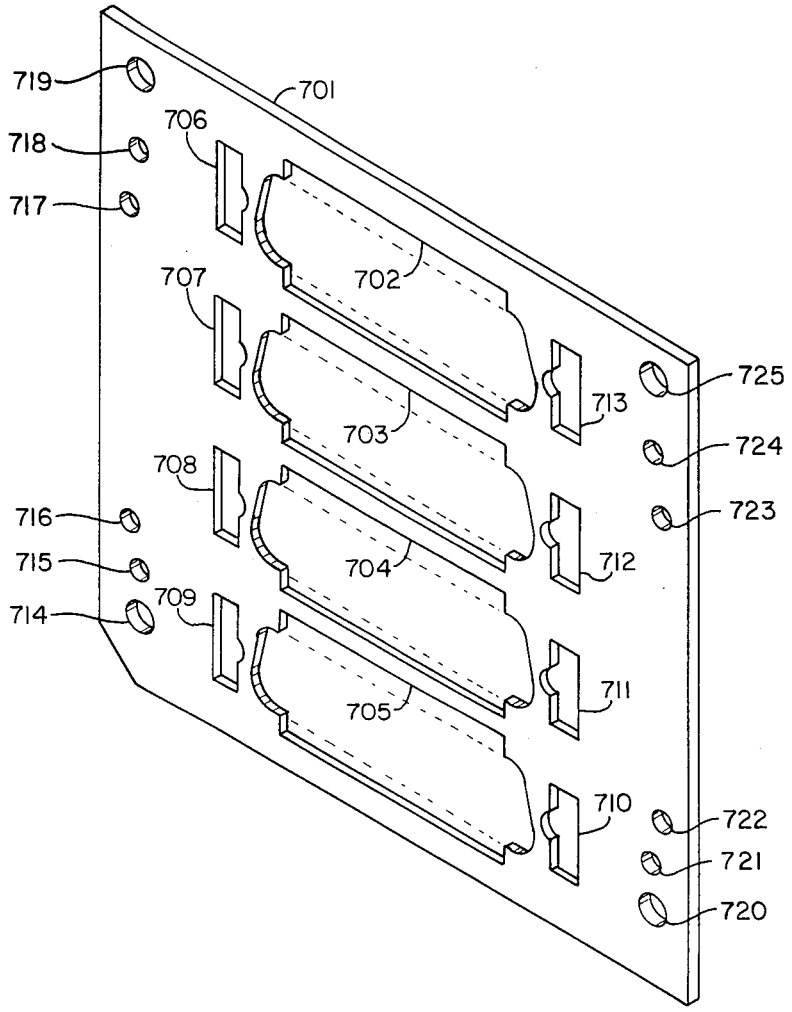
FIG. 7 is a three-dimensional drawing showing the bulkhead mounting plate utilized as part of the invention.

Referring now to FIG. 7, there is shown the bulkhead mounting plate 701 which permits the mounting of D-subminiature connectors utilizing standard prior art cable mounting procedures, as well as the new latch and lock pressed version molded assembly techniques. The mounting plate has cutouts 702, 703, 704, 705 each of which has a center opening delineated by dotted lines. This center opening orients the D-shell connector in the keyed direction and permits it to pass through. The additional side-cutouts are for adapting a piece-part application of a secondary box that is normally used in the field and not shown in the drawings. Side oblong cutouts, marked 706–713, are utilized for latching with a latch and lock molded connector as shown on FIG. 5. There are various holes on the edges of the plate 714–725 which are utilized to adapt the plate for both backward and forward compatibility for any new system.

From the foregoing description it should be realized that while the present invention has been described in connection with certain particular embodiments thereof, it is to be understood that modifications of these embodiments, as well as other embodiments, utilizing the underlying principles of the invention are included within the spirit and scope of the invention, which is to be limited only by the accompanying claims.

What is claimed is:

1. An apparatus for connecting an electrical cable having a first D-type electrical connector assembly with an electrical cable having a second D-type electrical connector assembly comprising in combination:

(a) a bulkhead for mounting and latching said first D-type electrical connector assembly, said bulkhead having at least one first aperture for permitting a portion of one of said first or second D-type electrical connector assemblies to protrude through said bulkhead and further including second apertures;

(b) a first flange on said first D-type electrical connector assembly having threaded inserts pressed into said first flange;

(c) at least one cylindrical bud-stud having a head and tail section with a smooth cylindrical undercut section between said head and tail section, said tail section having external threads for mating through said second apertures on said bulkhead with said threaded inserts on said first flange, and latching said first D-type electrical connector assembly to said bulkhead, said head section having a portion of its head section countersunk and internal threads therein; and, (d) a second flange on said second D-type electrical connector assembly having at least one captive-threaded insert for mating with said internal threads of the head-section of said bud stud, whereby said first and second D-type electrical connector assemblies are latched and locked onto said bulkhead and to each other.

2. An apparatus for connecting an electrical cable having a first D-type electrical connector assembly with an electrical cable having a second D-type electrical connector assembly comprising in combination:

(a) a bulkhead for mounting and latching said first D-type electrical connector assembly, said bulkhead having at least one first aperture for permitting a portion of one of said first or second D-type electrical connector assemblies to protrude through said bulkhead and further including second apertures;

(b) a first flange on said first D-type electrical connector assembly having threaded inserts pressed into said first flange;

(c) at least one cylindrical bud-stud having a head and tail section with a smooth cylindrical undercut section between said head and tail section, said tail section having external threads for mating through said second apertures on said bulkhead with said threaded inserts on said first flange, and latching said first electrical connector to said bulkhead, said head section having a portion of its head section countersunk and including internal threads therein; and, (d) at least one spring-loaded latching arm rotatably mounted on said second D-type electrical connector assembly for engaging the undercut portion of said bud-stud, whereby said first and second electrical connectors are latched and locked onto said bulkhead and to each other.

3. The apparatus as recited in claim 2 wherein said spring-loaded latching arm includes an elongated latching head at its latching end, and wherein the lower extremity of said latching head is curved to fit around a portion of the cylindrical undercut section of said bud-stud.

4. The apparatus as recited in claim 3 wherein said elongated latching-head includes a leading edge which is curved and tapered in order to ride over the head section of said bud-stud while in the process of being latched to the undercut portion of said bud-stud.

5. An apparatus for connecting a first electrical cable having a first D-type electrical connector assembly with a second electrical cable having one of two different forms of a second D-type electrical connector assembly attached to it, the first form of the second D-type electrical connector assembly comprising a first-form-flange with at least one captive first male threaded insert, while the second form of said second D-type electrical connector assembly is comprised of at least one rotatably-mounted, spring-loaded latching arm, said apparatus comprising:

(a) a bulkhead for mounting and latching said D-type electrical connector assemblies, said bulkhead having at least one first aperture for permitting a portion of one of said D-type electrical connector assemblies to protrude through said bulkhead and further including second apertures;

(b) a first flange on said first D-type electrical connector assembly having first female threaded inserts pressed into said first flange;

(c) at least one cylindrical bud-stud having a head and tail section with a smooth cylindrical undercut section between said head and tail section, said tail section having second male threads for mating through said second apertures on said bulkhead with said first female threaded inserts on said first flange, and latching said first D-type electrical connector assembly to said bulkhead, said head section of said bud-stud having a portion of its head section countersunk with internal second female threads for receiving said first male threads;

whereby the first form of said second D-type electrical connector assembly, when attached to said second cable, latches and locks to said bulkhead by having the second female threads of the head section of said bud-stud threaded into the captive first male threads of said first form of said second D-type electrical connector assembly, thus said first D-type electrical connector assembly already latched to said bulkhead is also latched to said first form of said second D-type electrical connector assembly by having the first male threaded inserts on said first form of the second D-type electrical connector assembly mate with the internal second female threads of said head section of said bud-stud; and alternately when said second electrical cable is equipped with the second form of said second D-type electrical connector assembly having at least one rotatably-mounted, spring-loaded latching arm for latching to the undercut section of said bud-stud thus latching said first D-type electrical connector assembly to said bulkhead and to the second form of said second D-type electrical connector assembly.

6. The apparatus as recited in claim 5 wherein said spring-loaded latching arm includes an elongated latching head at its latching end, and wherein the lower extremity of said latching head is curved to fit around a portion of the smooth cylindrical undercut section of said bud-stud.

7. The apparatus as recited in claim 6 wherein said elongated latching-head includes a leading edge which is curved and tapered in order to ride over the head section of said bud-stud while in the process of being latched to the undercut portion of said bud-stud.

* * * * *